US007281738B2

(12) United States Patent
Shen et al.

(10) Patent No.: US 7,281,738 B2
(45) Date of Patent: Oct. 16, 2007

(54) INTERCHANGEABLE HANDLE ASSEMBLY FOR LOCK

(75) Inventors: Mu-Lin Shen, Tainan (TW); Hung-Jen Tien, Shanhua (TW)

(73) Assignee: I-Tek Metal Mfg, Co., Ltd., Tainan (TW)

( * ) Notice: Subject to any disclaimer, the term of this patent is extended or adjusted under 35 U.S.C. 154(b) by 4 days.

(21) Appl. No.: 11/306,790

(22) Filed: Jan. 11, 2006

(65) Prior Publication Data

US 2007/0170731 A1 Jul. 26, 2007

(51) Int. Cl.
*E05B 3/00* (2006.01)

(52) U.S. Cl. ..... 292/353; 292/348

(58) Field of Classification Search ..... 293/336.3, 293/348, 353

See application file for complete search history.

(56) References Cited

U.S. PATENT DOCUMENTS 1,488,014 A * 3/1924 McDonald ..... 292/353
2,574,330 A * 11/1951 Judd ..... 403/107
3,477,309 A * 11/1969 Sprecher ..... 74/547
4,189,248 A * 2/1980 Sully ..... 403/11
6,386,602 B1 * 5/2002 Lan ..... 292/336.3

* cited by examiner

*Primary Examiner*—Gary Estremsky
(74) *Attorney, Agent, or Firm*—Alan Kamrath; Kamrath & Associates PA

(57) ABSTRACT

An interchangeable handle assembly includes a spindle, a coupling member removably coupled to the spindle, and a handle. Two grooves are defined in an outer circumferential face of the spindle. The coupling member includes two arms and an intermediate section between the arms. The arms are engaged in the grooves of the spindle. Each arm includes a coupling section on a distal end thereof. The handle includes a shank having a hole for removably coupling with the spindle. A circumferential wall delimiting the hole of the shank includes two coupling sections for respectively coupling with the coupling sections of the coupling member when the handle is coupled with the coupling member.

4 Claims, 7 Drawing Sheets

INTERCHANGEABLE HANDLE ASSEMBLY FOR LOCK

BACKGROUND OF THE INVENTION

1. Field of the Invention

The present invention relates to a handle assembly. More particularly, the present invention relates to an interchangeable handle assembly for a lock.

2. Description of the Related Art

FIGS. 1 and 2 of the drawings illustrate a conventional handle assembly 1 comprising a spindle 11 and a handle 12. The spindle 11 includes a slot 112 in a circumferential wall thereof. The spindle 11 further includes two diametrically opposed grooves 113 in an outer circumferential face 111 thereof. The handle 12 includes a shank 121 having a hole 122 that has a diameter slightly greater than that of the spindle 11. An engaging plate 14 is biased by a spring 13 to extend through the slot 112 into an engaging groove 123 in a circumferential wall delimiting the hole 122 of the shank 121, thereby coupling the handle 12 with the spindle 11. Two diametrically opposed protrusions 124 are formed on the circumferential wall delimiting the hole 122 of the shank 121 for coupling with the grooves 113 of the spindle 11, improving the engaging strength between the handle 12 and the spindle 11. A spring device 15 is mounted around the spindle 11 for returning the handle 12 after a torque applied to the handle 12 is released.

The protrusions 124 on the handle 12 enhance the engaging strength between the spindle 11 and the handle 12 at the cost of sacrificing the interchangeability of the handle 12. More specifically, a typical handle for a door lock is formed by forging a copper material that has excellent anticorrosive and mechanical properties and that allows easy surface treatment or by pressing a stainless steel material. Formation of the protrusions 124 can only be made by casting some suitable materials. As a result, the handle 12 could not be simply replaced with another made of copper or stainless steel without detaching the spindle 11. In other words, the spindle 11 also has to be detached when replacing the handle 12 with a handle made of copper or stainless steel. Manufacture and interchangeability of the handle are largely limited.

BRIEF SUMMARY OF THE INVENTION

An interchangeable handle assembly in accordance with the present invention comprises a spindle, a coupling member removably coupled to the spindle, and a handle. Two grooves are defined in an outer circumferential face of the spindle. The coupling member comprises two arms and an intermediate section between the arms. The arms are engaged in the grooves of the spindle. Each arm comprises a coupling section on a distal end thereof. The handle comprises a shank including a hole for removably coupling with the spindle. A circumferential wall delimiting the hole of the shank comprises two coupling sections for respectively coupling with the coupling sections of the coupling member when the handle is coupled with the coupling member.

Preferably, each coupling section of the coupling member is a protrusion and each coupling section of the handle is a groove.

Preferably, an outer end wall delimiting each groove of the spindle comprises a notch, and the intermediate section of the coupling member is engaged in the notches when the coupling member is coupled with the spindle.

Preferably, the spindle comprises a slot in a circumferential wall thereof. The circumferential wall delimiting the hole of the shank comprises an engaging groove. An engaging plate is biased by a spring to extend through the slot of the spindle into the engaging groove of the shank, thereby coupling the handle with the spindle.

Preferably, a spring device is mounted around the spindle for returning the handle.

The handle assembly in accordance with the present invention allows easy interchange of the handle without the need of detaching the spindle while allowing easy manufacture of the handle.

Other objectives, advantages, and novel features of the invention will become more apparent from the following detailed description when taken in conjunction with the accompanying drawings.

DETAILED DESCRIPTION OF THE INVENTION

Figure 3:
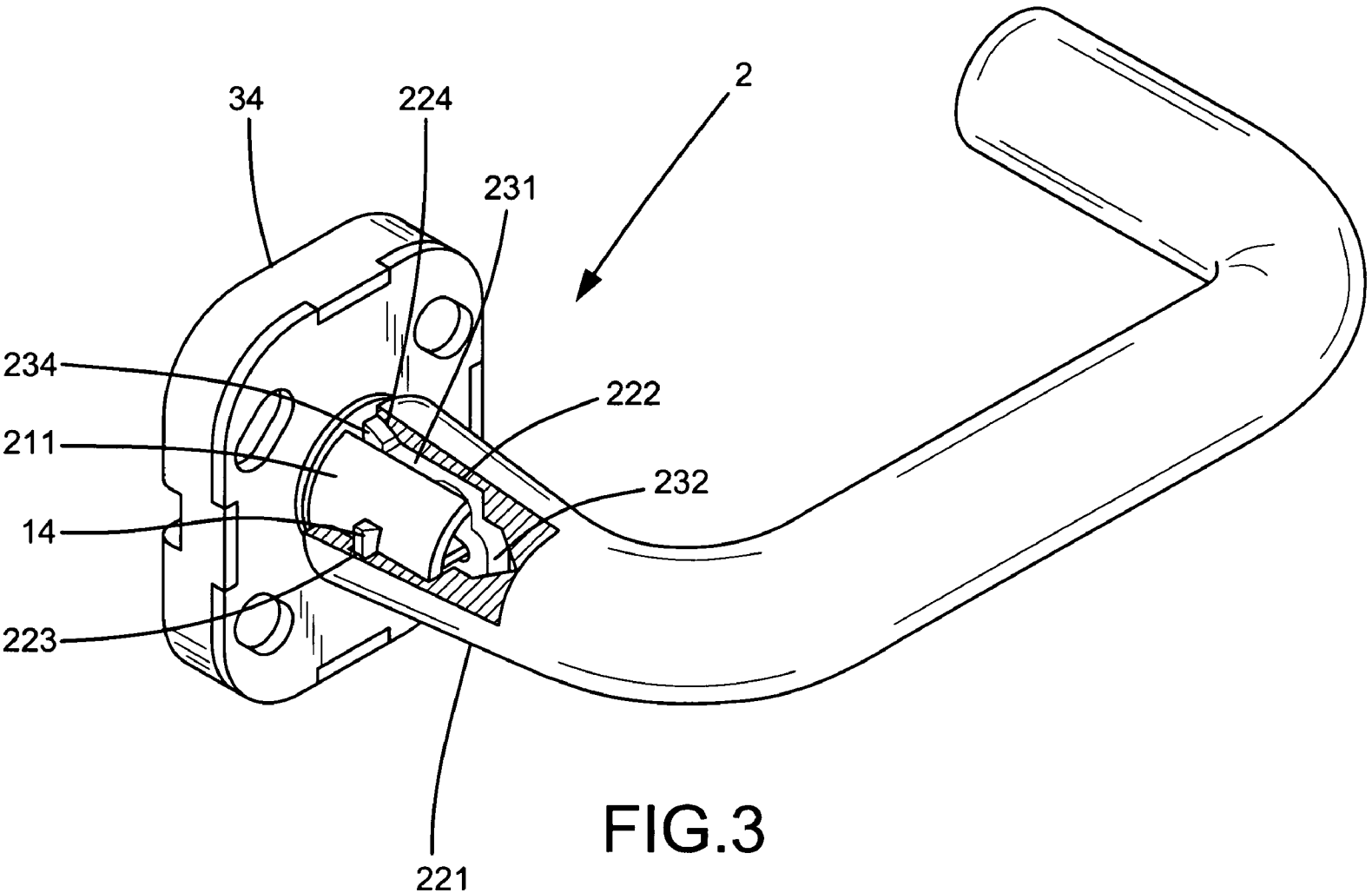
FIG. 3 is a perspective view, partly cutaway, of an interchangeable handle assembly in accordance with the present invention.
Figure 4:
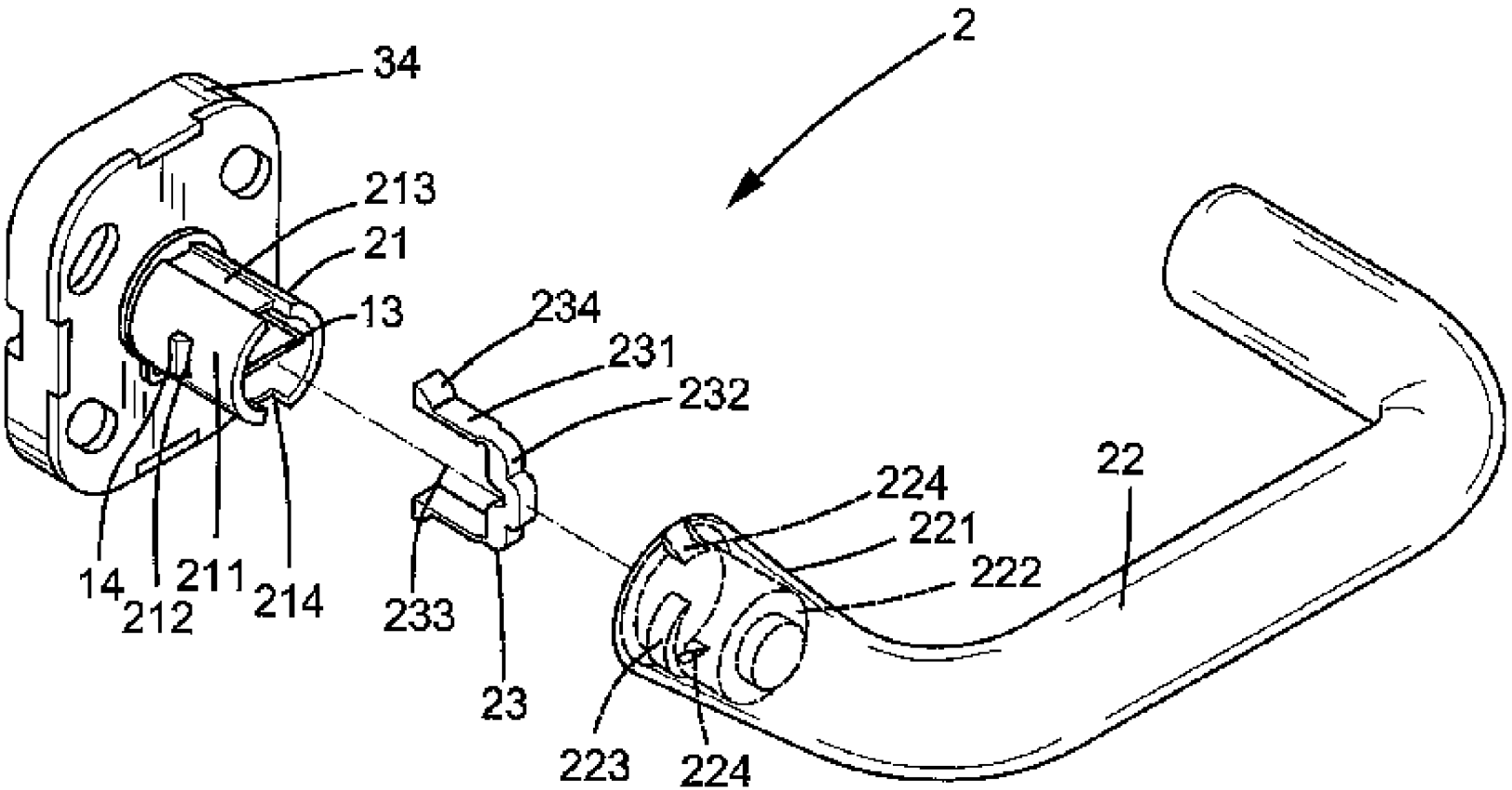
FIG. 4 is an exploded perspective view of the interchangeable handle assembly in accordance with the present invention.

Referring to FIGS. 3 and 4, an interchangeable handle assembly 2 in accordance with the present invention comprises a spindle 21, a handle 22, and a coupling member 23. The spindle 21 includes a slot 212 in a circumferential wall thereof. The spindle 21 further includes two diametrically opposed grooves 213 in an outer circumferential face 211 thereof, with a notch 214 defined in an outer end wall delimiting each groove 213.

The handle 22 includes a shank 221 having a hole 222 that has a diameter slightly greater than that of the spindle 21. An engaging plate 14 can be biased by a spring 13 to extend through the slot 212 into an engaging groove 223 in a circumferential wall delimiting the hole 222 of the shank 221, thereby coupling the handle 22 with the spindle 21. Further, the circumferential wall delimiting the hole 222 of the shank 221 includes two coupling sections. In this example, the coupling sections are two diametrically opposed grooves 224.

The coupling member 23 in this example is substantially U-shaped and comprises two arms 231 and an intermediate section 232 between the arms 231, with each arm 231 including a coupling section (in the form of a protrusion 234 in this example) on a distal end thereof and with the arms 231 defining a space 233 therebetween. The space 233 has a width slightly greater than a distance between the grooves 213 of the spindle 21. Preferably, each arm 231 has a shape allowing it be fittingly received in an associated groove 213. More specifically, the coupling member 23 can be coupled to the spindle 21 with the space 233 facing the spindle 21. Each arm 231 is engaged in an associated groove 213 and thus clamped on the outer circumferential face 211. Further, the intermediate section 232 of the coupling member 23 is engaged and thus positioned in the notches 214 of the spindle 21. Alternatively, the arms 231 of the coupling member 23 slightly expand outward when mounting the coupling member 23 to the spindle 21.

The handle 22 is then coupled with the spindle 21. The engaging plate 14 is biased by the spring 13 to extend through the slot 212 of the spindle 21 into the engaging groove 223 in the circumferential wall delimiting the hole 222 of the shank 221, thereby coupling the handle 22 with the spindle 21. Further, the protrusion 234 of each arm 231 of the coupling member 23 is engaged with an associated groove 224 of the shank 221, thereby enhancing the coupling strength between the spindle 21 and the handle 22. The handle 22 and the coupling member 23 can be removed from the spindle 21 when desired.

Figure 5:
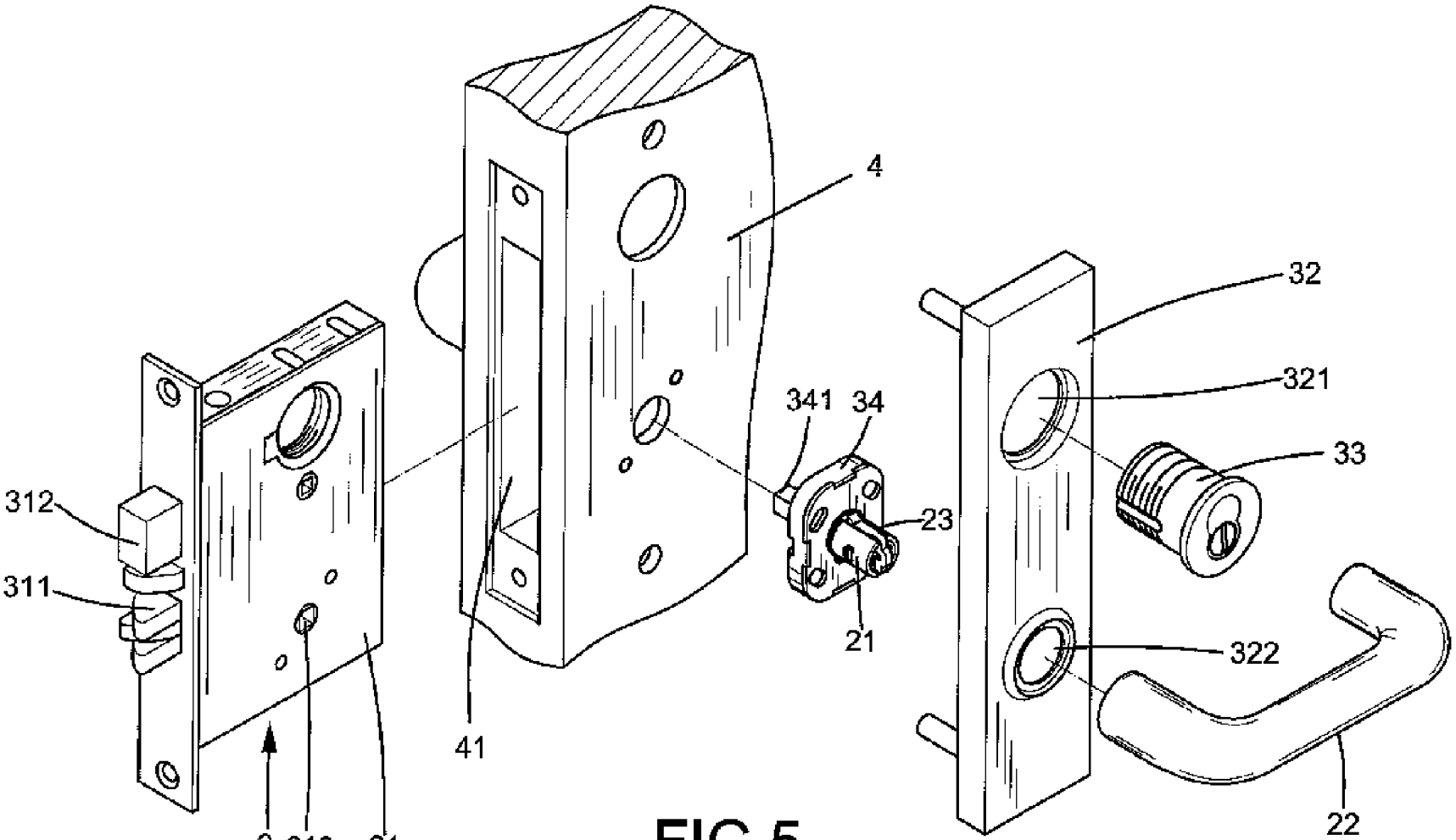
FIG. 5 is an exploded perspective view illustrating a portion of a door and a lock comprising the interchangeable handle assembly in accordance with the present invention.
Figure 6:
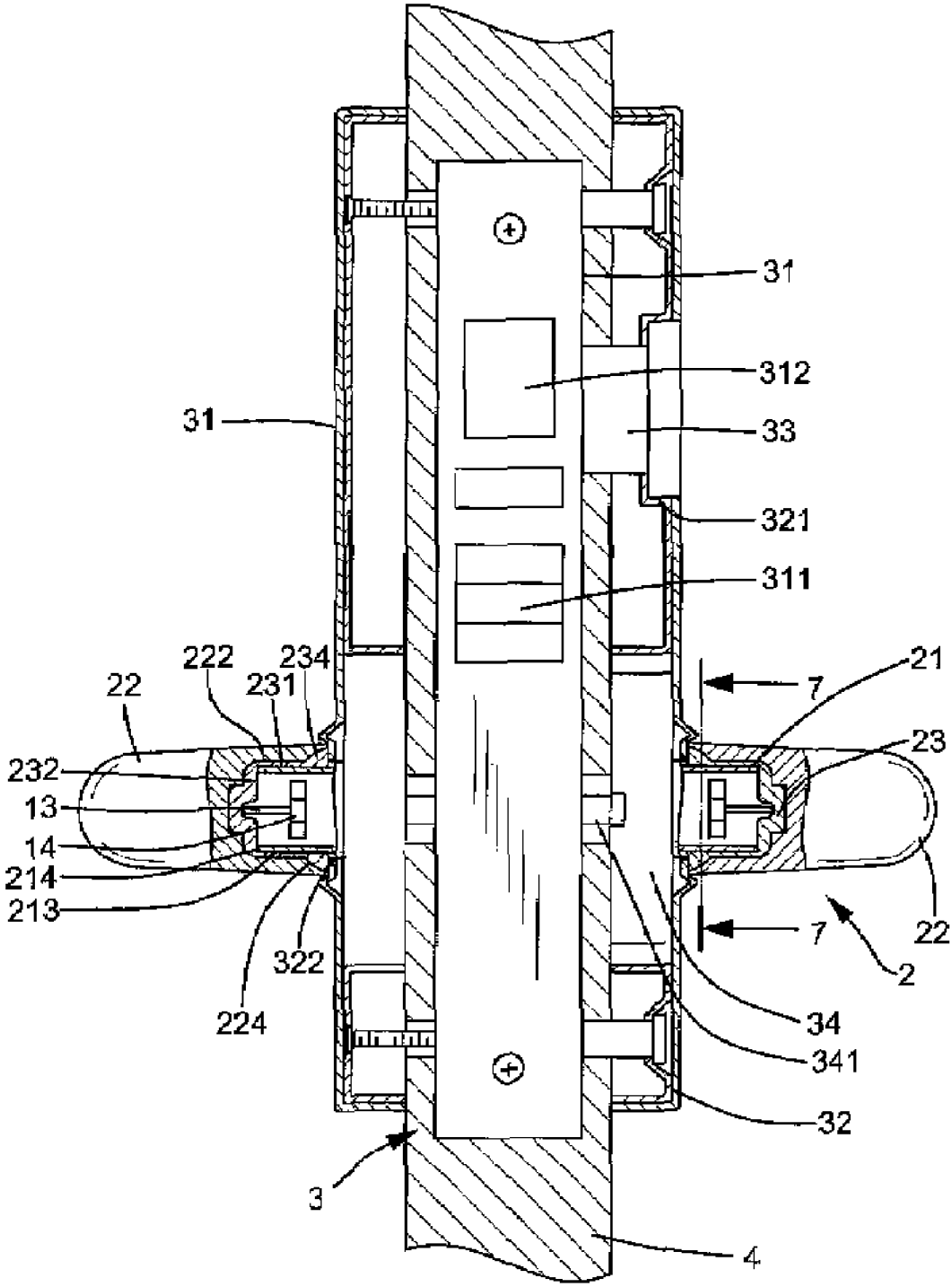
FIG. 6 is a sectional view of the door and the lock in FIG. 5.
Figure 7:
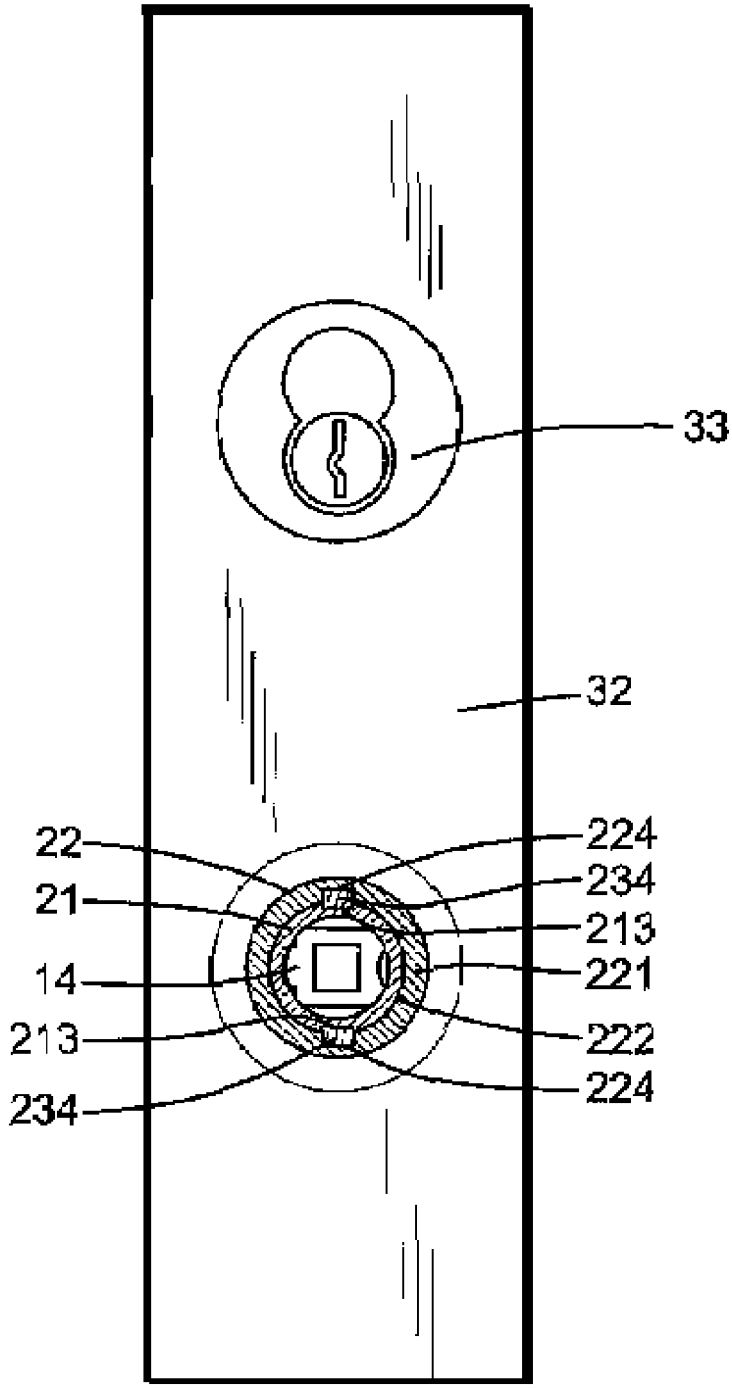
FIG. 7 is a sectional view taken along plane 7-7 in FIG. 6.

Referring to FIGS. 5 through 7, the handle assembly 2 in accordance with the present invention can be used in a conventional door lock 3. The lock 3 comprises a lock case 31 mounted in a compartment 41 in an edge of a door 4, an escutcheon 32 mounted to an outer side of the door 4, and a lock cylinder 33 mounted in a hole 321 in the escutcheon 32. The lock case 31 includes a latch bolt 311 and a deadbolt 312. The escutcheon 32 includes another hole 322 through which the spindle 21 extends. A spring device 34 is mounted around the spindle 21 for returning the handle 22 after a torque applied to the handle 22 is released. A square bar 341 extends out of the spring device 34 into a hole 313 of the lock case 31 for retracting the latch bolt 311 when the handle 22 is turned, which is conventional.

Figure 1:
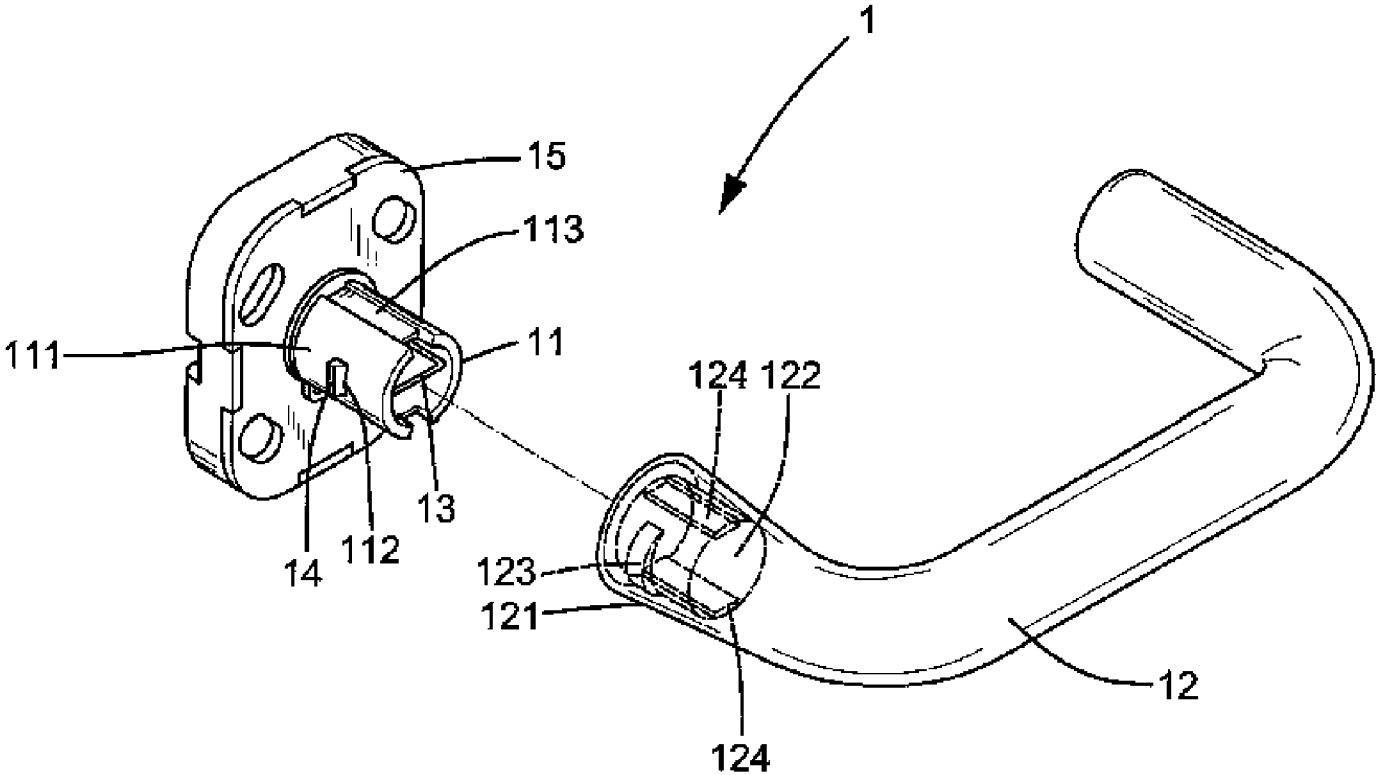
FIG.1 PRIOR ART
FIG. 1 is an exploded perspective view of a conventional handle assembly.
Figure 2:
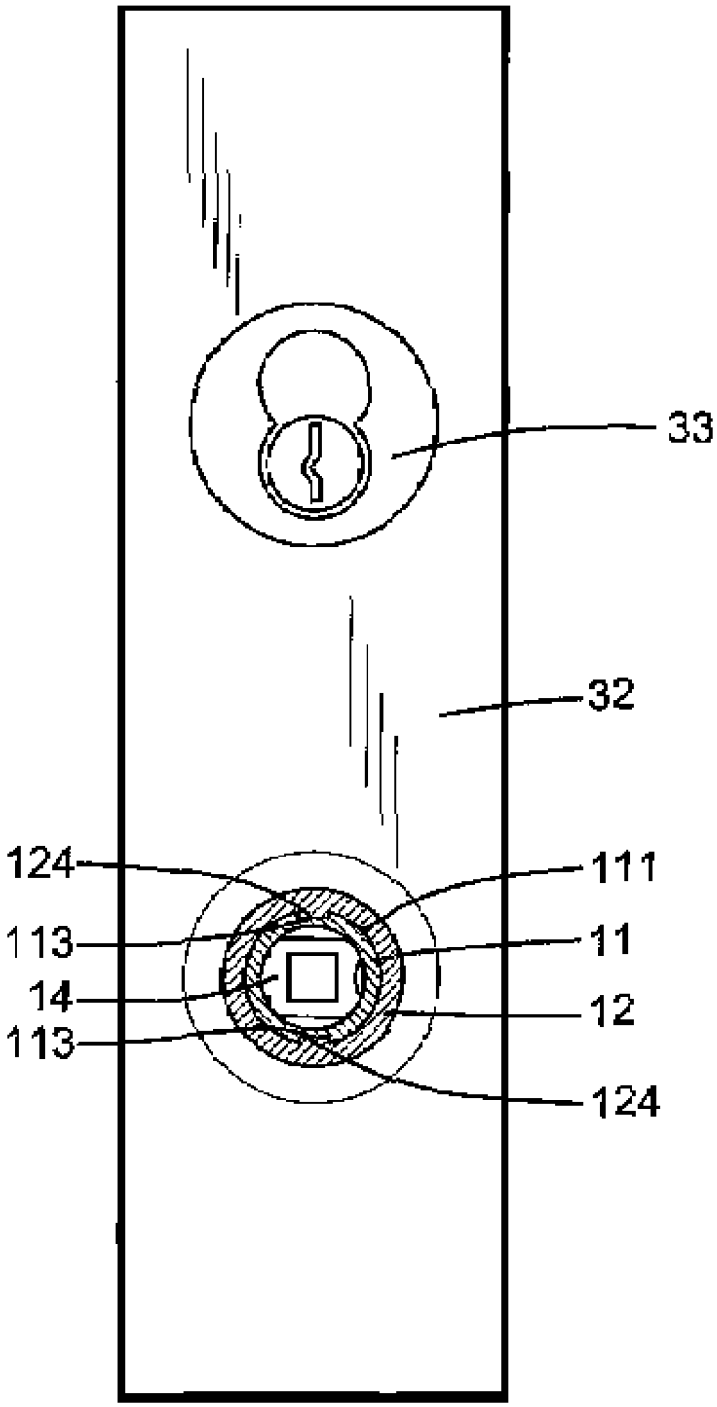
FIG.2 PRIOR ART
FIG. 2 is an elevational view, partly sectioned, of an escutcheon to which the conventional handle assembly is mounted.

The handle 22 in accordance with the present invention has no protrusion that limits manufacturing of the handle 22. More specifically, the handle 22 in accordance with the present invention can be manufactured by forging, pressing, or casting. The spindle 21 in accordance with the present invention can be coupled with the handle 22 in accordance with the present invention via the coupling member 23 or directly coupled with a conventional handle 12 shown in FIG. 1. Replacement of the handle 22 can be easily achieved without detaching the spindle 21.

Although specific embodiments have been illustrated and described, numerous modifications and variations are still possible without departing from the essence of the invention. The scope of the invention is limited by the accompanying claims.

What is claimed is:

1. An interchangeable handle assembly comprising:

a spindle comprising two grooves defined in an outer circumferential face of the spindle, with the spindle further comprising a slot in a circumferential wall thereof;

a coupling member removably coupled to the spindle, the coupling member comprising two arms and an intermediate section between the arms, said arms being engaged in the grooves of the spindle, each said arm comprising a coupling section on a distal end thereof;

a handle comprising a shank including a hole for removably coupling with the spindle, a circumferential wall delimiting the hole of the shank comprising two coupling sections for respectively coupling with the coupling sections of the coupling member when the handle is coupled with the coupling member, with the circumferential wall delimiting the hole of the shank further comprising an engaging groove;

an engaging plate; and a spring for biasing the engaging plate to extend through the slot of the spindle into the engaging groove of the shank, thereby coupling the handle with the spindle.

2. The interchangeable handle assembly as claimed in claim 1, with each said coupling section of the coupling member being a protrusion, and with each said coupling section of the handle being a groove.

3. The interchangeable handle assembly as claimed in claim 1, with an outer end wall delimiting each said groove of the spindle comprising a notch, and with the intermediate section of the coupling member being engaged in the notches when the coupling member is coupled with the spindle.

4. The interchangeable handle assembly as claimed in claim 1, with the interchangeable handle assembly further comprising a spring device mounted around the spindle for returning the handle.

* * * * *